US007594401B1

(12) United States Patent
Chen et al.

(10) Patent No.: US 7,594,401 B1
(45) Date of Patent: Sep. 29, 2009

(54) COMBUSTOR SEAL HAVING MULTIPLE COOLING FLUID PATHWAYS

(75) Inventors: Wei Chen, Greer, SC (US); Marcus Byron Huffman, Simpsonville, SC (US); David James Taylor, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1 day.

(21) Appl. No.: 12/100,679

(22) Filed: Apr. 10, 2008

(51) Int. Cl.
*F02C 7/20* (2006.01)

(52) U.S. Cl. ..... 60/752; 60/755; 60/756

(58) Field of Classification Search ..... 60/752, 60/755, 756, 757, 800
See application file for complete search history.

(56) References Cited

U.S. PATENT DOCUMENTS 4,785,623 A * 11/1988 Reynolds ..... 60/796
5,333,443 A * 8/1994 Halila ..... 60/796
5,373,694 A * 12/1994 Clark ..... 60/804
5,400,586 A * 3/1995 Bagepalli et al. ..... 60/800
6,418,727 B1 * 7/2002 Rice et al. ..... 60/799
2006/0277921 A1 * 12/2006 Patel et al. ..... 60/804
2007/0012048 A1 * 1/2007 Buret et al. ..... 60/804

* cited by examiner

*Primary Examiner*—Michael Cuff
*Assistant Examiner*—Vikansha S Dwivedi
(74) *Attorney, Agent, or Firm*—Cantor Colburn LLP

(57) ABSTRACT

A combustor for a gas turbine includes a first combustor component and a second combustor component. The second combustor component is at least partially insertable into the first combustor component, and the first combustor component and second combustor component define a combustion fluid pathway. A combustor seal is located between the first combustor component and the second combustor component. The combustor seal defines at least one inner cooling pathway between the combustor seal and the second combustor component and at least one outer cooling pathway between the combustor seal and the first combustor component for cooling the first combustor component and second combustor component. A method for cooling a first combustor component and a second combustor component is also disclosed.

19 Claims, 8 Drawing Sheets

COMBUSTOR SEAL HAVING MULTIPLE COOLING FLUID PATHWAYS

BACKGROUND

The subject invention relates to combustors. More particularly, the subject invention relates to sealing between combustor components.

Air management is an important consideration in combustor design. Air streams provide an oxidizer for a combustion process and also provide cooling to hot components of the combustor. Seals are typically provided between various components of the combustor to prevent hot combustion gas from leaking from the combustor. Seal configurations and functions are unique in a combustor. A seal providing complete sealing of flow from one area to another may not be desired, but rather a seal resulting in a small amount of cooling air "leak" may be preferred. Within combustion zones, cooling must be properly designed to provide adequate cooling for components while only minimally disturbing combustion ignition and stability. Cooling air streams "leaked" through the seal may also be directed to reducing thermal-acoustic oscillation of the combustor.

These seals typically include C-Rings, fingered hula rings, cloth seals, and the like, and are subjected to high temperature and pressure as well as high gradients of pressure and temperature across the seals. Current seals can be further improved for provision of cooling flow to overcome excessive leakage around the seal at various levels of temperature and/or pressure and during temperature and/or pressure transitions, and/or wear of the seal.

BRIEF DESCRIPTION OF THE INVENTION

A combustor for a gas turbine includes a first combustor component and a second combustor component. The second combustor component is at least partially insertable into the first combustor component, and the first combustor component and second combustor component define a combustion fluid pathway. A combustor seal is located between the first combustor component and the second combustor component. The combustor seal defines at least one inner cooling pathway between the combustor seal and the second combustor component and at least one outer cooling pathway between the combustor seal and the first combustor component for cooling the first combustor component and second combustor component.

A method for cooling a first combustor component and a second combustor component includes locating a combustor seal radially between the first combustor component and the second combustor component. Cooling fluid flows through at least one inner cooling pathway defined by the combustor seal and the second combustor component. Cooling fluid also flows through at least one outer cooling pathway defined by the combustor seal and the second combustor component. The spent cooling fluid then flows into the combustion fluid.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
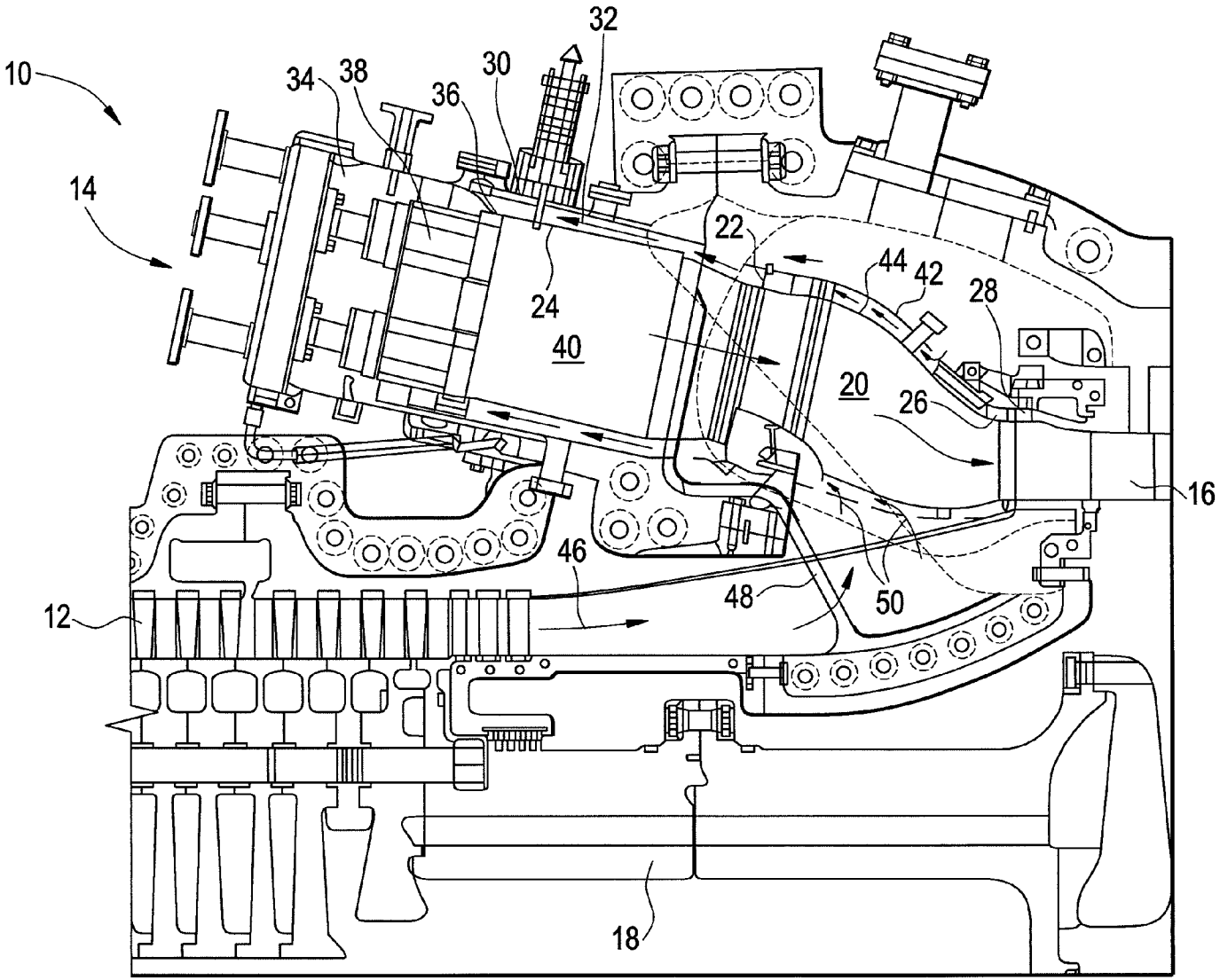
FIG. 1 is a schematic cross-sectional view of a gas turbine.

Shown in FIG. 1 is a gas turbine 10. The gas turbine 10 includes a compressor 12 which provides compressed fluid to a combustor 14. Fuel is injected into the combustor 14, mixes with the compressed air and is ignited. The hot gas products of the combustion flow to a turbine 16 which extracts work from the hot gas to drive a rotor shaft 18 which in turn drives the compressor 12. A transition piece 20 is coupled at an upstream end 22 to the combustor 14 at a combustor liner 24 and at a downstream end 26 to an aft frame 28 of the turbine 16. The transition piece 20 carries hot gas flow from the combustor liner 24 to the turbine 16. The combustor 14 includes a combustor sleeve 30 spaced radially outward from the combustor liner 24 defining a combustor flow channel 32 therebetween. A combustor cap 34 is coupled to an upstream end 36 of the combustor liner 24 and includes at least one nozzle 38 disposed therein an extending into a combustion chamber 40 defined by the combustor cap 34 and the combustor liner 24. An impingement sleeve 42 is coupled to the combustor sleeve 30 and is radially spaced from the transition piece 20 defining a transition flow channel 44 therebetween.

During operation, discharge flow 46 flows from the compressor 12 through a diffuser 48 to the impingement sleeve 42. The discharge flow 46 proceeds through a plurality of impingement holes 50 in the impingement sleeve 42 and toward the combustor 14 in the transition flow channel 44. The discharge flow 46 proceeds from the transition flow channel 44 and through the combustor flow channel 32 until it is finally introduced to the combustor liner 24 through the at least one nozzle 38. In addition to providing air to the combustor 14 for the combustion process, the relatively cool discharge flow 46 further provides much needed cooling to the components exposed to hot combustion gas, for example, the combustor liner 24 and the transition piece 20.

Figure 2:
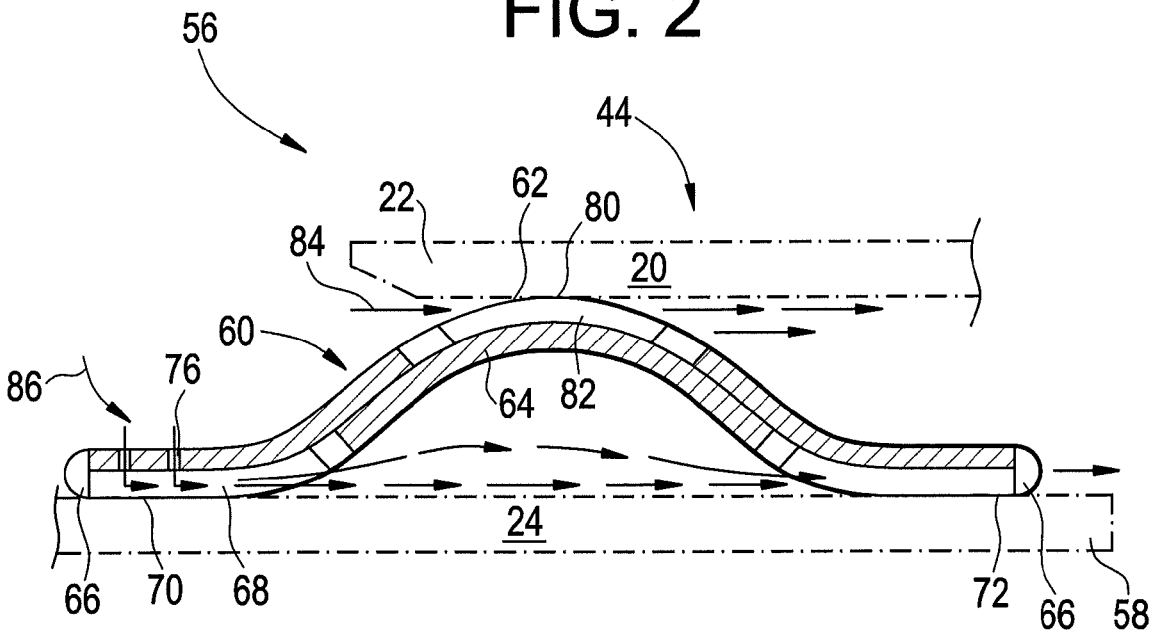
FIG. 2 is a cross-sectional view of a portion of a combustor of the gas turbine of FIG. 1 including an embodiment of a combustor seal.

As shown in FIG. 2, interfaces between adjacent components exposed to hot combustion gases, for example, the transition piece 20 and the combustor liner 24, are configured as lap joints 56 wherein, for example, a downstream end 58 of the combustor liner 24 is configured to be insertable into the upstream end 22 of the transition piece 20. A seal 60 is disposed radially between the overlapping portions of the transition piece 20 and the combustor liner 24 and extends perimetrically around the joint 56. Another example of such an application is one in which the seal 60 disposed between overlapping portions of the combustor liner 24 and the combustor cap 34. Yet another example of such application is one in which the seal 60 is disposed between overlapping portions of the combustor cap 34 and the at least one nozzle 38. In one embodiment, the seal 60 of is configured with a wave-shaped cross section and includes two layers, an outer seal 62 and an inner seal 64. In some embodiments, the seal 60 includes at least one support 66 comprising, for example, a weld, which secures the seal 60 to at least one of the transition piece 20 or the combustor liner 24.

Figure 3:
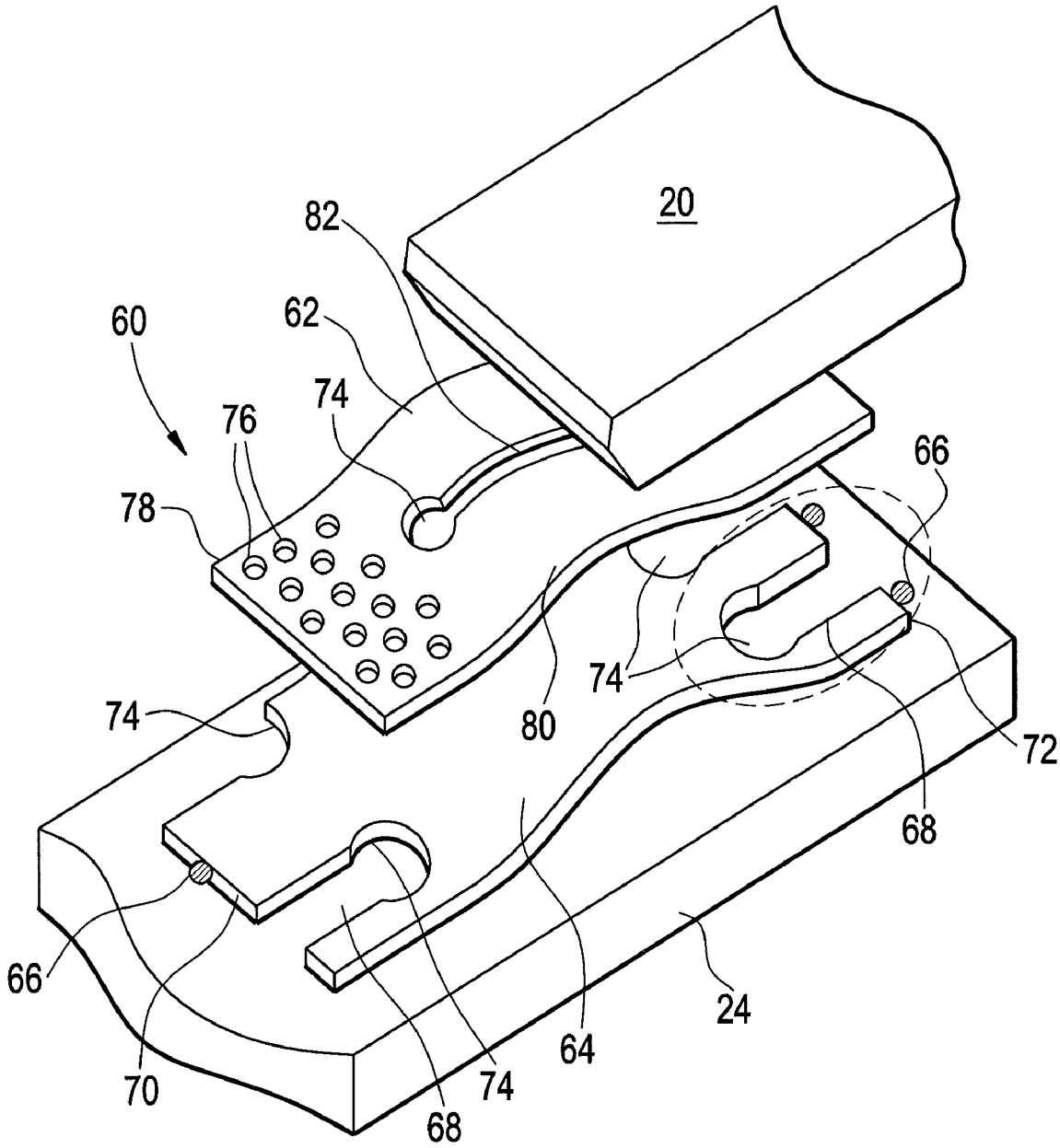
FIG. 3 is a partially exploded view of the combustor seal of FIG. 2.

Referring now to FIG. 3, the inner seal 64 includes at least one inner seal slot 68 disposed at an upstream inner seal end 70 and open at the upstream inner seal end 70. The inner seal 64 further includes at least one inner seal slot 68 disposed at a downstream inner seal end 72 and open at the downstream inner seal end 72. The at least one inner seal slot 68 may include one or more scallops 74 to reduce stress in the inner seal 64 at the inner seal slot 68. The outer seal 62 includes a plurality of impingement holes 76 disposed at an upstream outer seal end 78. At least one of the impingement holes 76 is located over at least one inner seal slot 68. A wave section 80 of the outer seal 62 includes at least one wave slot 82 which may include one or more scallops 74 to reduce stress in the outer seal 62 at the wave slot 82.

Referring now to FIG. 2, the seal 60 is disposed between transition piece 20 and the combustor liner 24 such that the inner seal 64 contacts the combustor liner 24 at the upstream inner seal end 70 and the downstream inner seal end 72. The outer seal 62 contacts the transition piece 20 at the wave section 80. In operation, a portion of the flow through the transition flow channel 44 flows past an upstream end 22 of the transition piece 20 and between the transition piece 20 and combustor liner 24. A first portion 84 of the flow proceeds through the at least one wave slot 82 thereby providing cooling to the transition piece 20, and a second portion 86 of the flow through the inner seal slots 68 and/or the impingement holes 76 thereby providing cooling to the combustor liner 24. While the embodiment of FIG. 3 has two seal layers, configurations having different numbers of seal layers, for example, one layer or three layers, are contemplated within the scope of the present disclosure.

Figure 4:
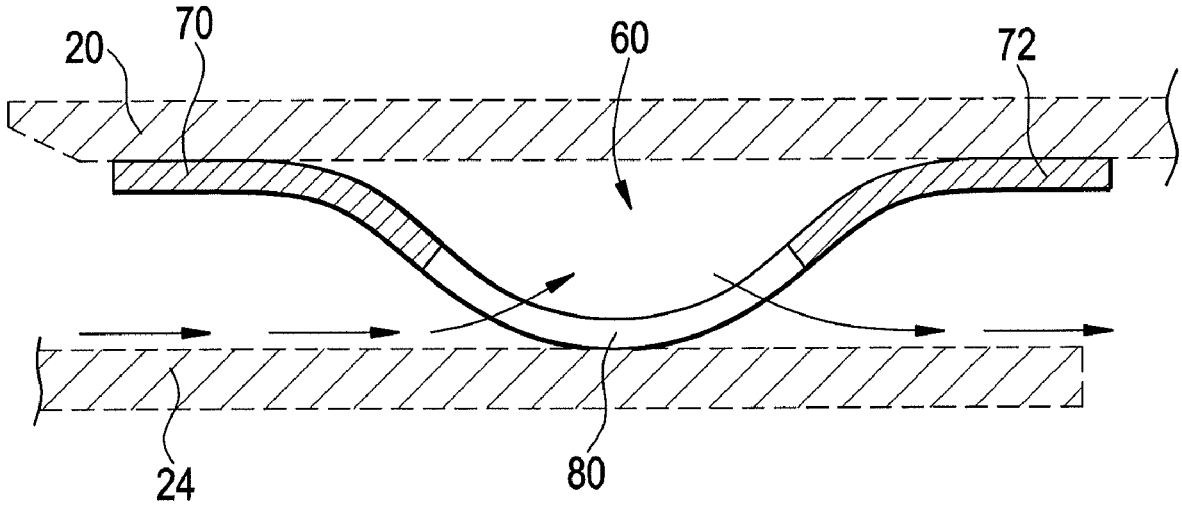
FIG. 4 is a cross-sectional view of an embodiment of a reversed seal of FIG. 2.

In an embodiment as shown in FIG. 4, the seal 60 of FIG. 2 may be reversed or flipped such that the upstream inner seal end 70 and the downstream inner seal end 72 contact the transition piece 20, and the seal 60 contacts the combustor liner 24 at the wave section 80. Reversal of the seal 60 as shown in FIG. 4 can enhance cooling of the combustor liner 24 such that other cooling flows to the combustor liner 24 can be reduced or eliminated. In this embodiment, the seal 60 is fixed to the transition piece 20 so thermal expansion and/or installation displacement of the transition piece 20 will not affect the performance of the seal 60.

Figure 5:
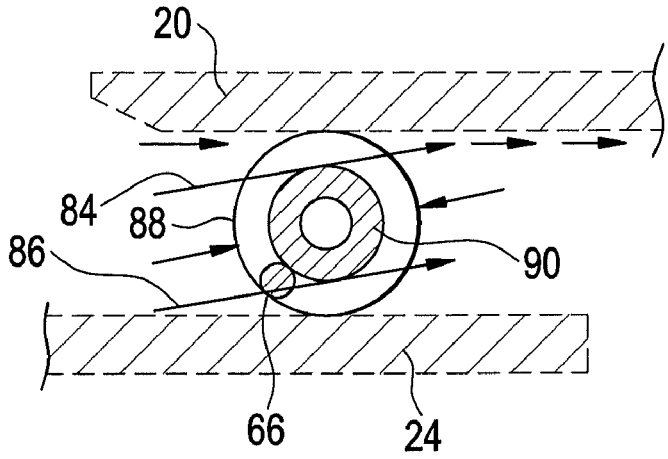
FIG. 5 is a cross-sectional view of an embodiment of a combustor seal including a coil.
Figure 6:
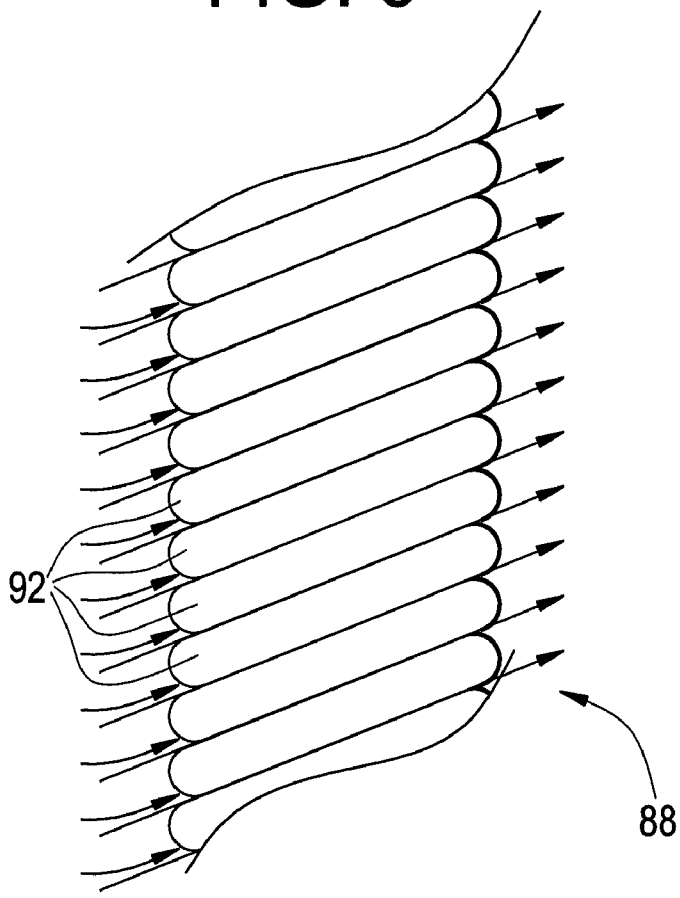
FIG. 6 is a plane view of the combustor seal of FIG. 5.

In another embodiment as shown in FIG. 5, the seal 60 comprises a coil 88 disposed radially between the transition piece 20 and the combustor liner 24 and contacting both the transition piece 20 and combustor liner 24. The coil 88 extends perimetrically around the joint 56 and is secured to at least one of the transition piece 20 or the combustor liner 24 by at least one support 66. A sleeve 90, which is shown with annular cross-section, is located inside the coil 88. The coil 88 and the sleeve 90 are configured to allow the flow to proceed between coil windings 92 as shown in FIG. 6. Referring again to FIG. 5, the first portion 84 proceeds between coil windings 92 to provide cooling to the transition piece 20, and the second portion 86 proceeds between coil windings 92 to provide cooling to the combustor liner 24, while the sleeve 90 provides sealing to prevent undesired outflow of hot gas from the transition piece 20.

Figure 7:
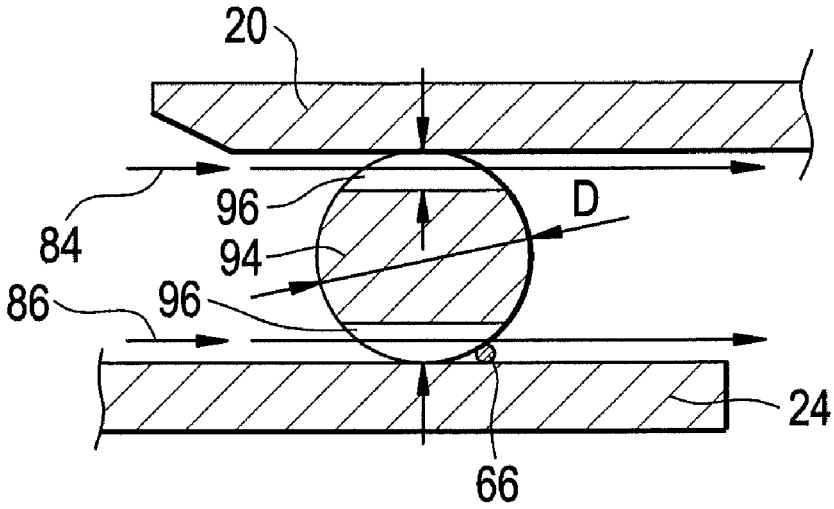
FIG. 7 is a cross-sectional view of yet another embodiment of a combustor seal.
Figure 8:
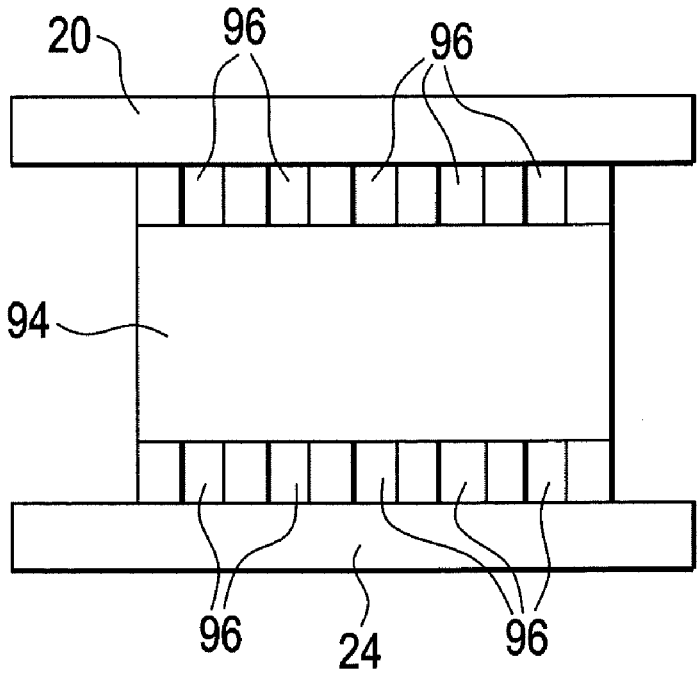
FIG. 8 is a plane view of the combustor seal of FIG. 7.

In another embodiment shown in FIG. 7, the seal 60 comprises a solid or tubular rod 94 disposed radially between the transition piece 20 and the combustor liner 24 and contacting both the transition piece 20 and the combustor liner 24. The rod 94 extends perimetrically around the joint 56 and is secured to at least one of the transition piece 20 or the combustor liner 24 by at least one support 66. A plurality of cooling slots 96 are disposed in the rod 94 as shown in FIG. 8 to provide cooling flow to the transition piece 20 and the combustor liner 24. The cooling slots 96 shown in FIG. 8 are disposed substantially axially in the rod 94, but it is to be appreciated that cooling slots 96 disposed in other angular directions are contemplated within the scope of the present disclosure.

Figure 9:
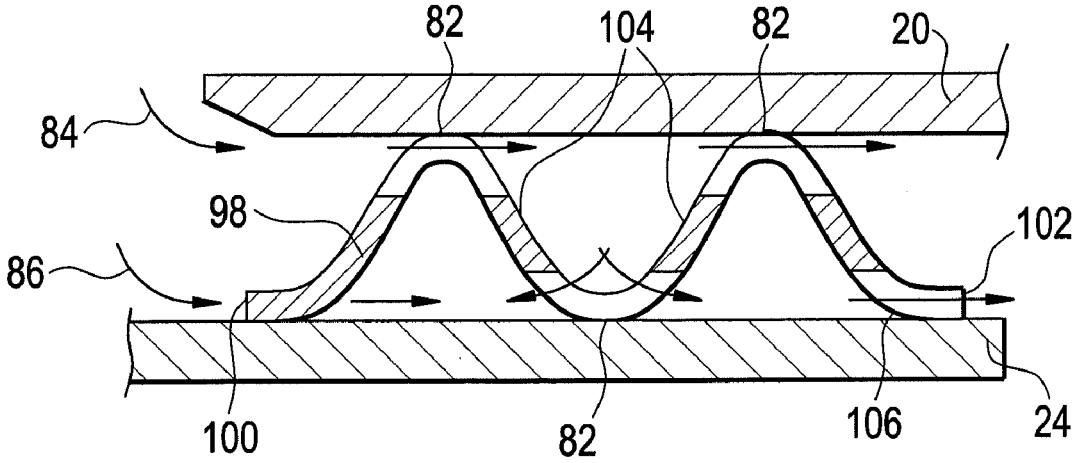
FIG. 9 is a cross-sectional view of an embodiment of a combustor seal having multiple wave sections.
Figure 10:
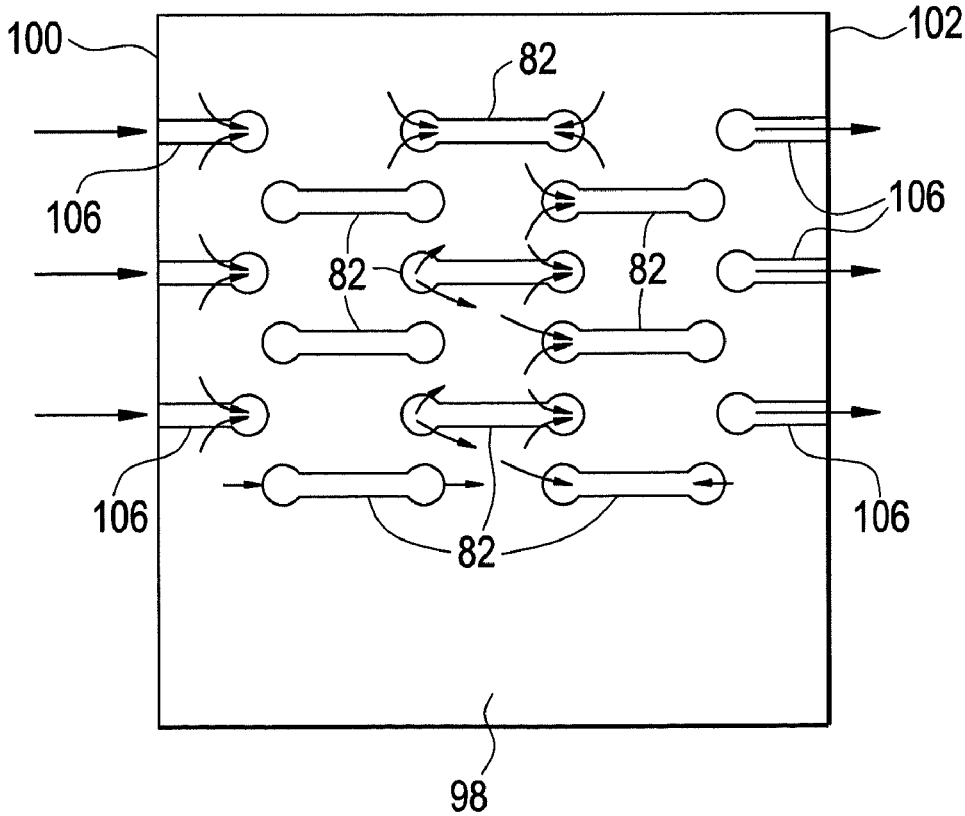
FIG. 10 is a plane view of the combustor seal of FIG. 9.

Another alternative embodiment of a seal 60 is illustrated in FIG. 9. The seal 60 comprises at least one seal layer 98 having a upstream seal end 100, a seal downstream end 102, and a plurality of wave sections 104 disposed therebetween. The seal layer 98 extends perimetrically around the joint 56 and is secured to at least one of the transition piece 20 or the combustor liner 24 by at least one support 66 and includes at least one end slot 106 disposed at each seal end 100,102. Each wave section 104 contacts one of the transition piece 20 or the combustor liner 24 and includes at least one wave slot 82 as shown in FIG. 10. The at least one wave slot 82 may include one or more scallops 74 to reduce stress in the seal layer 98 at the wave slot 82. Referring again to FIG. 9, the first portion 84 proceeds through the wave slots 82 to provide cooling to the transition piece 20, and the second portion 86 proceeds through the end slots 106 disposed at the seal upstream end 100, through the wave slots 82 and through the end slots 106 disposed at the seal downstream end 102 to provide cooling to the combustor liner 24. While the embodiment shown in FIG. 9 includes three wave sections 104, and seal ends 100, 102 which contact the combustor liner 24, other quantities of wave sections 104 and other orientations of seal ends 100,102 are contemplated by the present disclosure.

Figure 11:
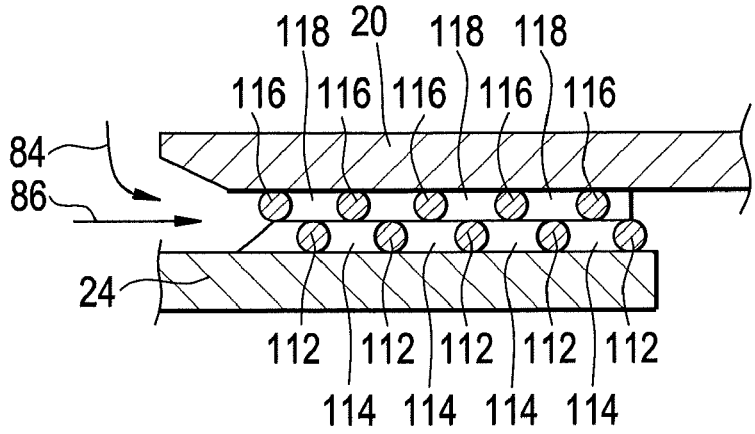
FIG. 11 is a cross-sectional view of a combustor seal having a mesh configuration.
Figure 12:
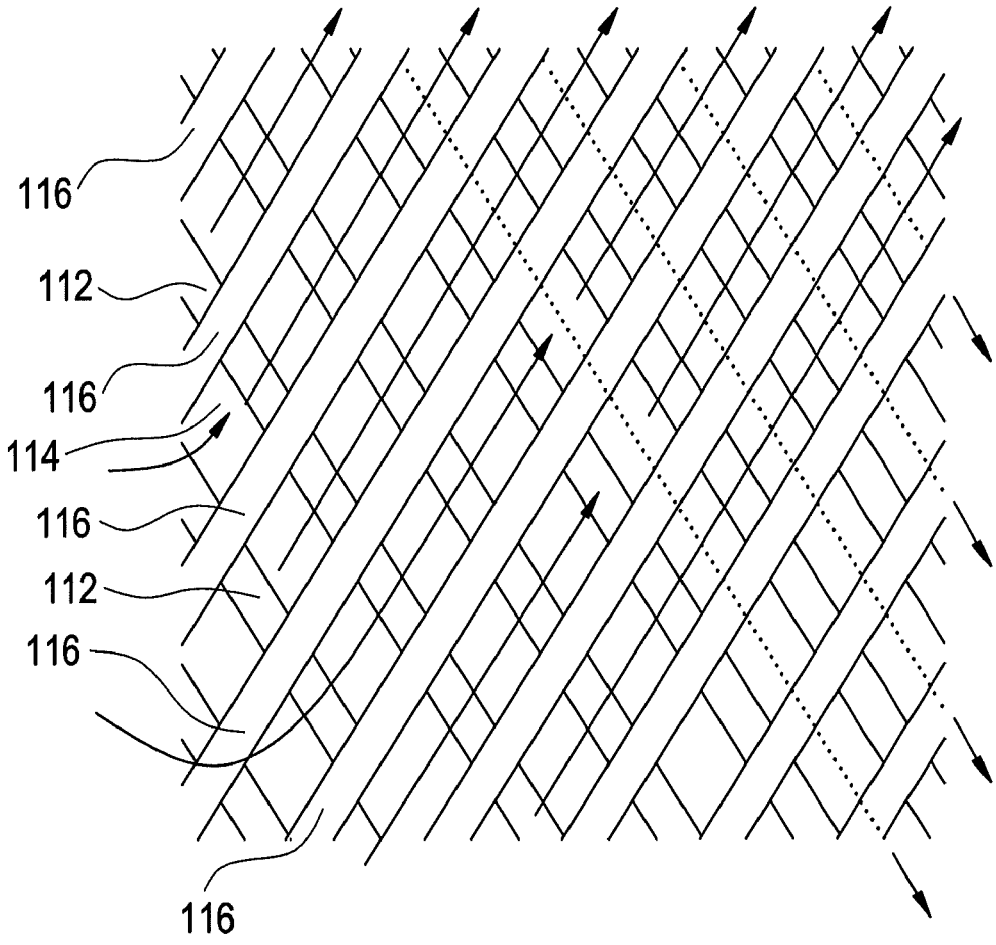
FIG. 12 is a plane view of the combustor seal of FIG. 11.

Yet another embodiment of a seal 60 is illustrated in FIG. 11. The seal 60 of this embodiment comprises a multi-layer mesh. The mesh in FIG. 11 has an inner mesh layer 108 and an outer mesh layer 110. The inner mesh layer 108 is formed from a plurality of, for example, inner wires 112 arranged to define a plurality of inner mesh channels 114. Similarly, the outer mesh layer 110 is formed from a plurality of, for example, outer wires 116 arranged to define a plurality of outer mesh channels 118. As shown in FIG. 12, the inner mesh layer 108 and the outer mesh layer 110 are configured such that a channel angle 120 exists between the inner mesh channels 114 and the outer mesh channels 118. The channel angle 120 of FIG. 12 is substantially 90 degrees, but it is to be appreciated that other channel angles 120 are contemplated depending on desired cooling effects. To provide cooling, the first portion 84 proceeds through the outer mesh channels 118 to provide cooling to the transition piece 20, and the second portion 86 proceeds through the inner mesh channels 114 to provide cooling to the combustor liner 24.

While the embodiments above describe seals 60 disposed between a transition piece 20 and a combustor liner 24, the seal 60 can be utilized at other locations in the combustor 14 or gas turbine 10, for example, between the transition piece 20 and the aft frame 28 or between the combustor liner 24 and the combustor cap 34.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combustor for a gas turbine comprising:

a first combustor component;

a second combustor component, the second combustor component at least partially insertable into the first combustor component, the first combustor component and second combustor component defining a combustion fluid pathway; and a combustor seal disposed between the first combustor component and the second combustor component, the combustor seal defining at least one inner cooling pathway between the combustor seal and the second combustor component and at least one outer cooling pathway between the combustor seal and the first combustor component for cooling the first combustor component and second combustor component.

2. The combustor of claim 1 wherein the combustor seal comprises:

an inner seal layer contacting the second combustor component and defining the at least one inner cooling pathway therethrough for providing cooling fluid from without the combustion fluid pathway to cool the second combustor component; and an outer seal layer contacting the first combustor component and defining the at least one outer cooling pathway therethrough for providing cooling fluid from without the combustion fluid pathway to cool the first combustor component.

3. The combustor of claim 2 wherein at least one of the inner seal layer and the outer seal layer has a wave-shaped cross section.

4. The combustor of claim 2 wherein the inner seal layer includes at least one inner seal slot defining the at least one inner cooling pathway.

5. The combustor of claim 2 wherein the outer seal layer includes at least one outer seal slot defining the at least one outer cooling pathway.

6. The combustor of claim 2 wherein an installation of the combustor seal is reversed to enhance cooling of the first combustor component or the second combustor component.

7. The combustor of claim 1 wherein the combustor seal comprises:

at least one coil including a plurality of windings;

at least one sleeve disposed inside the at least one coil, thereby defining the at least one inner cooling pathway between the second component, the at least one sleeve, and adjacent windings of the coil.

8. The combustor of claim 7 wherein the combustor seal defines the at least one outer cooling pathway between the first component, the at least one sleeve, and adjacent windings of the coil.

9. The combustor of claim 7 wherein the at least one sleeve has an annular cross-section.

10. The combustor of claim 1 wherein the combustor seal comprises at least one rod disposed radially between the first combustor component and the second combustor component, the at least one rod including:

at least one inner slot defining the inner cooling pathway between the at least one rod and the second turbine component; and at least one outer slot defining the outer cooling pathway between the at least one rod and the first turbine component.

11. The combustor of claim 10 wherein the at least one rod has a hollow cross-section.

12. The combustor of claim 1 wherein the combustor seal comprises:

an inner mesh layer having a plurality of inner wires defining the at least one inner cooling pathway between adjacent inner wires;

an outer mesh layer having a plurality of outer wires defining the at least one outer cooling pathway between adjacent outer wires.

13. The combustor of claim 1 including at least one support for retaining the combustor seal in a desired position between the first combustor component and the second combustor component.

14. The combustor of claim 13 wherein the at least one support is a weld.

15. The combustor of claim 1 wherein the first combustor component is a transition piece.

16. The combustor of claim 14 wherein the second combustor component is a combustor liner.

17. A method for cooling a first combustor component and a second combustor component comprising:

locating a combustor seal radially between the first combustor component and the second combustor component, the second combustor component at least partially insertable into the first combustor component, the first combustor component and second combustor component defining a combustion fluid pathway;

flowing cooling fluid from without the combustion fluid pathway through at least one inner cooling pathway defined by the combustor seal and the second combustor component; and flowing cooling fluid from without the combustion fluid pathway through at least one outer cooling pathway defined by the combustor seal and the second combustor component.

18. The method of claim 17 wherein flowing cooling fluid through at least one inner cooling pathway includes flowing the cooling fluid through at least one inner seal slot in the combustor seal.

19. The method of claim 17 wherein flowing cooling fluid through at least one outer cooling pathway includes flowing the cooling fluid through at least one outer seal slot in the combustor seal.

* * * * *